United States Patent [19]

Jarret

[11] 4,060,347

[45] Nov. 29, 1977

[54] LIQUID FUEL PUMPING APPARATUS

[75] Inventor: Boaz Antony Jarret, Sevenoaks, England

[73] Assignee: Cav Limited, Birmingham, England

[21] Appl. No.: 720,090

[22] Filed: Sept. 2, 1976

[30] Foreign Application Priority Data

Sept. 16, 1975 United Kingdom ..... 37968/75

[51] Int. Cl.[2] ..... F04B 17/00

[52] U.S. Cl. ..... 417/392; 92/13; 123/139 AR; 417/349; 417/507

[58] Field of Search ..... 417/46, 560, 507, 390, 417/398–401, 344–346, 322, 289, 47, 339, 348, 326, 379, 398, 392; 91/50, 6, 12, 31, 275, 443; 123/139 R, 139 AS, 139 AR, 139 AD, 139 AE, 139 AP, 139 AQ, 139 E

[56] References Cited

U.S. PATENT DOCUMENTS

| | | | |
|---|---|---|---|
| 1,525,859 | 2/1925 | Ferrari | 417/46 |
| 3,171,331 | 3/1965 | Samuel | 91/443 X |
| 3,357,310 | 12/1967 | Rohde | 91/6 |
| 3,481,587 | 12/1969 | Ruhnau | 417/390 X |
| 3,487,783 | 1/1970 | Curran et al. | 417/399 X |
| 3,919,989 | 11/1975 | Jarrett et al. | 123/139 R |

*Primary Examiner*—William L. Freeh
*Assistant Examiner*—Edward Look

[57] ABSTRACT

A fuel injection pumping apparatus includes a first valve means for supplying fuel under pressure to one end of a piston the displacement of which effects fuel flow to the engine at a substantially unrestricted rate, and a second valve means which when opened allows fluid to flow at a restricted rate by virtue of an orifice, to the cylinder containing the aforesaid piston whereby the fuel flow to the engine is at a restricted rate.

4 Claims, 3 Drawing Figures

FIG. 1.
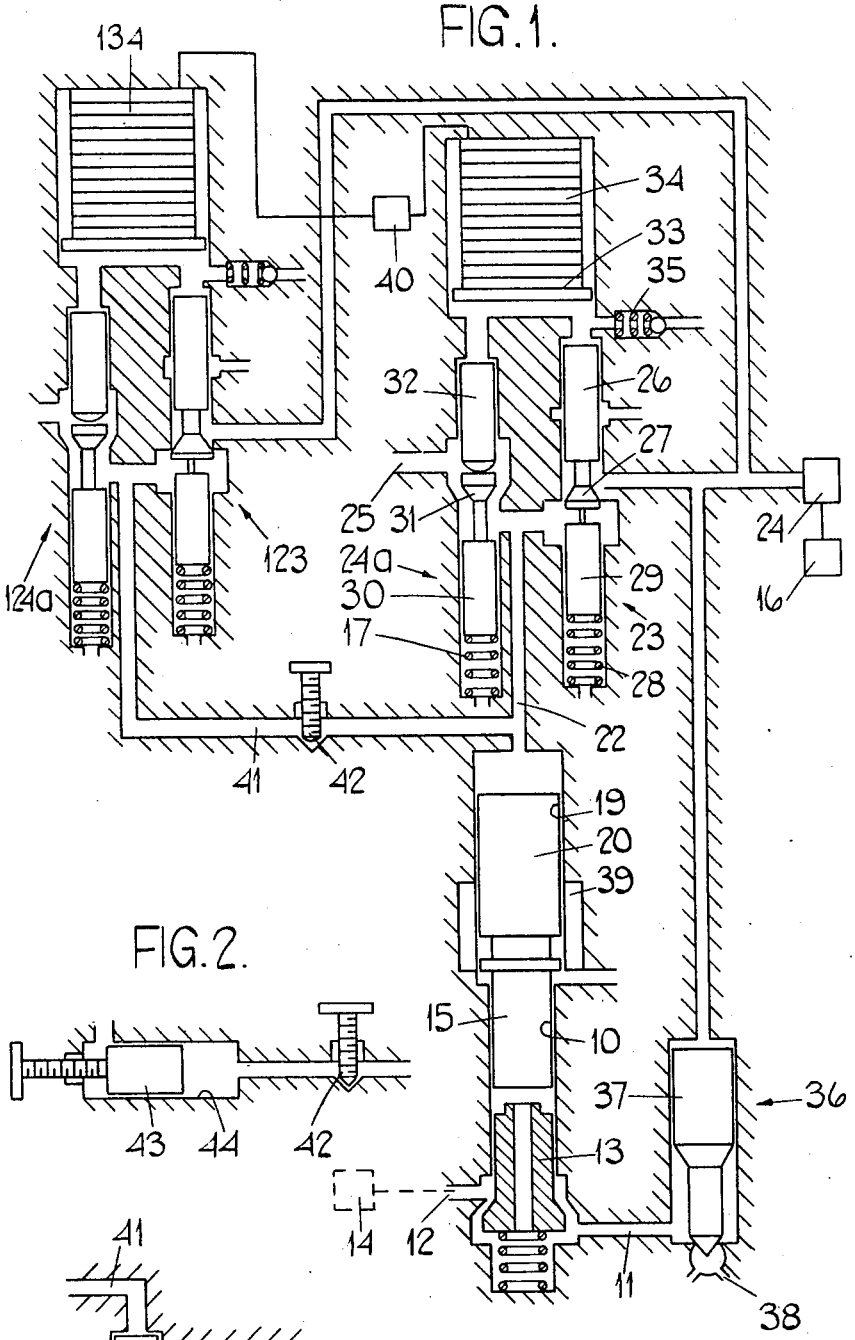
FIG. 2.
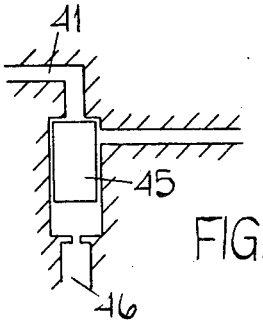
FIG. 3.

LIQUID FUEL PUMPING APPARATUS

This invention relates to fuel injection pumping apparatus for supplying fuel to internal combustion engines, and comprises in combination, a displacement piston located within a cylinder, an outlet from one end of the cylinder, a fluid pressure operable member mounted within a further cylinder for actuating said piston and causing fuel to be delivered through said outlet, means operable upon movement of the piston to a predetermined position in said cylinder during delivery of fuel through said outlet by the piston to terminate flow of fuel through the outlet and valve means operable to place an end of said further cylinder in communication with a source of fluid under pressure to effect movement of the displacement piston in a direction to deliver fuel through said outlet, or with a drain to permit return motion of the piston.

The object of the invention is to provide such an apparatus in a simple and convenient form.

According to the invention an apparatus of the kind specified comprises a further valve means operable to place said one end of the further cylinder in communication with the source of fluid under pressure to effect movement of the displacement piston in a direction to deliver fuel through said outlet, the apparatus also including a restricted orifice interposed between said further valve means and said one end of said further cylinder, the arrangement being such that further valve means may be operated before said first mentioned valve means when it is required to supply fuel through the outlet, said orifice determining the rate of fuel supply through said outlet, said first mentioned valve means being operated when the full rate of fuel supply is required.

In the accompanying drawings,

FIG. 1 is a diagrammatic representation of one example of the apparatus,

FIG. 2 shows a modification to the example of FIG. 1 and,

FIG. 3 shows a further modification to the example of FIG. 1.

Referring to FIG. 1 of the drawings there is provided a cylinder 10 one end of which communicates with an outlet 11 and a fuel inlet 12, the latter being connected to a source of fuel 14. There is provided within the cylinder 10, a valve element 13 which is spring loaded to the closed position by which as will be described, can be opened mechanically or by fuel under pressure supplied through the inlet 12. Located within the cylinder 10 is a displacement piston 15. A further cylinder 19 is provided and this is disposed coaxially with the cylinder 10 and contains a fluid pressure operable member in the form of a piston 20. The cylinder 19 is of larger diameter than the cylinder 10 and the space surrounding the portion of the displacement piston 15 which extends into the cylinder 19 is vented to a drain.

The other end of the further cylinder 19 is connected to a passage 22 which can be connected by way of a first valve 23 to an accumulator 24 which contains liquid, preferably fuel at a high pressure. The accumulator 24 is charged by means of a high pressure pump 16 driven by the associated engine. Alternatively the passage 22 may be connected by way of a valve **24*a* to a drain passage 25**.

The valve 23 includes a pressure actuated valve member 26 having an integral head 27. The head 27 is loaded into contact with the seating by means of a coiled compression spring 28 and in this position the supply of liquid from the accumulator 24 to the passage 22 is prevented. In addition, the valve member 26 is provided with a pressure balancing element 29 to which it is connected by a narrow stem.

The second valve **24*a* includes a slidabley valve element 30 including a head 31 which can co-operate with a seating to prevent flow of liquid from the passage 22 to the drain passage 25. The valve element 30 is spring loaded by means of a spring 17 in a direction to open the valve and it is moved to the closed position by means of a valve actuating piston 32. The piston 32 can be subjected to a fluid pressure developed by a piston 33 which itself is operated by a stack 34 of piezo electric crystals. In addition, the pressure developed by the piston 33 is applied to the valve member 26. The piston 33 is moved to develop a pressure upon energization of a stack of crystals and it has the effect of closing the valve 24*a* and opening the valve 23. The cylinder occupied by the piston 33 together with the chambers communicating therewith are maintained full of liquid conveniently fuel, by way of a non-return valve 35 connected to the source of fuel 14**.

As shown in the drawing, the outlet 11 is connected to an injection nozzle 36 which includes a differential valve 37 of the usual type. This valve is urged into contact with a seating to prevent flow of fuel through orifices 38 into a combustion space of an associated engine, by the application of fluid pressure from the accumulator 24.

The operation of the portion of the apparatus thus far described is as follows. In addition shown in the drawings, the valves 23 and **24*a* are in the position which they adopt during return motion of the displacement piston 15 and the piston 20. Such return motion being due to flow of fuel into the chamber 10 past the valve 13 which is moved during this time against the action of a spring loading to permit fuel to flow into the cylinder. After a predetermined movement as will be explained, the stack of crystals 34 is partly energized and the piston 33 develops fluid pressure which is applied to effect reversal of the position of the valve 24*a*. Valve 23 remains unaffected because the force exerted by the spring 28 is higher than that exerted by the spring 17. The valves remain in this position until the desired time for injection whereupon the stack of crystals is fully energized and the valve 23 is opened. In this situation pressure from the accumulator 24 is applied to the end of the piston 20 and this effects movement of the displacement piston 15 so as to pressurise the fuel in the outlet 11. When a predetermined pressure has been reached which it will be understood, is higher than the accumulator pressure, the valve member of the injector 36 is lifted and flow of fuel takes place through the outlet 11 and also through the orifices 38 to a combustion space of the associated engine. The flow of fuel through the orifices occurs until such time as the displacement piston 15 contacts the valve element 13. When this takes place the valve element 13 is positively lifted from its seating and the pressure in the outlet 11 falls to the outlet pressure of the source 14. The effect of this is to ensure that the valve 37 of the injector closes quickly. In addition, any surplus fuel in the cylinder 10 is discharged to the source 14**.

The stack of crystals 34 is maintained in its fully energised state for a sufficient length of time to allow the pressure in passage 11 to fall to the feed pressure of the source 14. When this has occurred, the crystals are de-energized and the valves 23 and 24a return to the positions shown in the drawing. In addition, the displacement piston 15 and the piston 20 move under the action of the fuel supplied by the source 14. The distance moved by the pistons 15 and 20 during the return motion as described, determines the amount of fuel which is supplied to the engine and this is carefully controlled by an electronic control circuit indicated at 40, which supplies electrical power to the stack of crystals 34. When it is required to deliver more fuel to the engine, the displacement piston and the piston 20 are allowed a longer stroke. The stroke of the member 20 is sensed by a sensing coil 39 and the signal developed by this coil is applied to the electronic control circuit. The electronic control circuit also receives signals indicative of a demand such for instance as engine speed and an actual engine operating parameter such for instance as the actual engine speed.

It is convenient to be able to control the rate at which fuel is initially supplied to the engine and this is conveniently achieved by providing additional valves 123 and 124a which are constructed and can operate in the same way as the valves 23 and 24a. The valves 123 and 124a are operated by a stack of crystals 134 which are energized from the control circuit 40. The valves 123 and 124a control the flow of liquid to the end of the cylinder 19 to which the passage 22 is connected and for this purpose a further passage 41 is provided. In FIG. 1 this passage is shown to incorporate an adjustable orifice 42 in practice however this orifice is of preset size.

In operation, if the valve 123 is opened then liquid flows from the accumulator 24 along the passage 41 to the cylinder 19 at a rate which is determined by the size of the orifice 42. By controlling the size of this orifice, the rate of liquid supply to the cylinder 19 can be controlled and therefore the rate of displacement of fuel by the displacement piston 15 is also controlled. The rate of injection of fuel to the engine is reduced as compared with that obtained when the valves 23 and 24a are operated. When it is required that the rate of injection of fuel should increase, then the valve 23 is opened as previously described. The amount of fuel supplied to the engine at the restricted rate is of course controlled by the delay is fully energising the stack of crystals 34 after the stack of crystals 134 has been fully energised.

FIG. 2 shows a modification of the apparatus shown in FIG. 1, the modification comprising the addition of a metering piston 43 which is contained within a cylinder 44 which effectively forms part of the passage 41. When the valve 123 is opened the piston 43 is displaced by the liquid flowing from the accumulator 24. This flow of liquid is of course at the restricted rate by virtue of the orifice 42 so that as in the previous example, the fuel flows to the engine at a restricted rate. When the piston 43 reaches the end of the cylinder 44 no further flow of liquid occurs and the delivery of fuel to the engine is stopped. The piston 15 will of course only have moved a comparatively small distance, it being appreciated that the piston 43 is of smaller cross-sectional area than the piston 15. When the piston 43 is halted the high pressure of fuel in the outlet 11 is depressurized by way of the injector. When the main volume of fuel is required the stack of crystals 34 is fully energized and substantially unrestricted flow of fuel takes place to the engine until of course the valve member 13 is displaced from its seating by the displacement piston 15. It is of course necessary to ensure that the metering piston 43 is returned to the opposite end of the cylinder 44 before the next injection of fuel to the engine. This is achieved by ensuring that the valve 124a is opened before the valve 24a thereby allowing the piston 43 to be returned during the initial return movement of the displacement piston 15.

In FIG. 3 the orifice 42 of the apparatus shown in FIG. 1 is replaced by a rate control piston 45 which is contained within a cylinder. The rate of movement of the control piston 45 is determined by a sharp edged orifice 46 and the piston constitutes an adjustable orifice in the passage 41. As in the previous example the valve 123 is operated first and the rate control piston 45 is subjected to the presssure in the accumulator 24, the rate of movement of the piston 45 being determined by the orifice 46. As the piston 45 moves it progressively increased the size of the orifice effectively defined by the piston 45 and the entrance or exit of the passage 41 to the cylinder. Again as in the previous example it is necessary to allow the piston 45 to return to its initial position before opening the valve 24a. The return motion of the piston 45 is effected by fuel under pressure conveniently from the source 14 which flows into the cylinder by way of the sharp edged orifice 46.

I claim:

1. A fuel injection pumping apparatus comprising a cylinder, a displacement piston located in said cylinder, a fuel outlet from one end of said cylinder, an inlet through which fuel can be admitted to said one end of the cylinder, a further cylinder, a fluid pressure operable member mounted within said further cylinder for moving said piston towards said one end of the first-mentioned cylinder thereby to cause fuel flow through said outlet, means operable upon movement of the piston to a predetermined position in said first-mentioned cylinder during delivery of fuel through said outlet to terminate flow of fuel through the outlet, valve means operable to place an end of said further cylinder in communication with a source of fluid under pressure to effect movement of the displacement piston in a direction to cause delivery of fuel through said outlet, further valve means operable to place said one end of the further cylinder in communication with the source of fluid under pressure to effect movement of the displacement piston in a direction to deliver fuel through said outlet, the apparatus also including a restricted orifice interposed between said further valve means and said one end of said further cylinder, whereby said further valve means may be operated before said first-mentioned valve means when it is required to supply fuel through the outlet, said orifice determining the rate of fuel supply through said outlet, said firstmentioned valve means being operated when the full rate of fuel supply through said outlet outlet is required.

2. An apparatus according to claim 1 including means for varying the size of said restricted orifice as flow of fuel at a restricted rate takes place.

3. An apparatus according to claim 2 in which said means for varying the size of said restricted orifice comprises a cylinder, a piston slidable in said cylinder, said piston acting to control the size of a port in the wall of said cylinder and constituting said restricted orifice, a passage communicating with one end of the cylinder, said passage communicating with said further valve means and with said port, and means for restricting the movement of the piston within the cylinder, the arrangement being such that when said further valve means is operated fluid will flow to said one end of the cylinder and through said port, the piston moving to vary the size of the port.

4. An apparatus according to claim 3 in which the means for restricting the movement of the piston comprises a sharp edged orifice through which fluid can flow from the other end of the cylinder.

* * * * *